US009475288B2

(12) United States Patent
Kudo et al.

(10) Patent No.: US 9,475,288 B2
(45) Date of Patent: Oct. 25, 2016

(54) LIQUID EJECTION HEAD AND MANUFACTURING METHOD OF LIQUID EJECTION HEAD

(71) Applicant: CANON KABUSHIKI KAISHA, Tokyo (JP)

(72) Inventors: Kiyomitsu Kudo, Machida (JP); Satoshi Kimura, Kawasaki (JP); Tomotsugu Kuroda, Yokohama (JP); Naoko Tsujiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/721,264

(22) Filed: May 26, 2015

(65) Prior Publication Data

US 2015/0343775 A1 Dec. 3, 2015

(30) Foreign Application Priority Data

May 30, 2014 (JP) ..... 2014-112741

(51) Int. Cl.

| | |
|---|---|
| ***B41J 2/015*** | (2006.01) |
| ***B41J 2/14*** | (2006.01) |
| ***B41J 2/16*** | (2006.01) |

(52) U.S. Cl.

CPC .. *B41J 2/14* (2013.01); *B41J 2/16* (2013.01); *B41J 2/1623* (2013.01); *B41J 2/1626* (2013.01); *B41J 2/1635* (2013.01); *B41J 2002/14362* (2013.01); *Y10T 29/49403* (2015.01)

(58) Field of Classification Search

None

See application file for complete search history.

(56) References Cited

U.S. PATENT DOCUMENTS

| | | | | |
|---|---|---|---|---|
| 6,109,735 | A | 8/2000 | Kashino et al. | |
| 6,305,789 | B1 | 10/2001 | Nakata et al. | |
| 6,378,992 | B2 | 4/2002 | Kudo et al. | |
| 6,386,686 | B1 | 5/2002 | Kubota et al. | |
| 6,508,544 | B1 * | 1/2003 | Sasaki | B41J 2/17523 347/84 |
| 6,910,759 | B2 | 6/2005 | Kawamura et al. | |
| 7,185,968 | B2 | 3/2007 | Kim et al. | |
| 8,562,109 | B2 | 10/2013 | Miyazaki et al. | |
| 8,567,908 | B2 | 10/2013 | Kudo et al. | |
| 2012/0007911 | A1 * | 1/2012 | Hagiwara | B41J 29/02 347/20 |

FOREIGN PATENT DOCUMENTS

| | | | |
|---|---|---|---|
| CN | 1344618 | A | 4/2002 |
| CN | 1541839 | A | 11/2004 |
| CN | 102673155 | A | 9/2012 |
| JP | 2002-019146 | A | 1/2002 |
| JP | 2002-113857 | A | 4/2002 |

(Continued)

OTHER PUBLICATIONS

Office Action in Japanese Patent Application No. 2014-112741, dated Jun. 2, 2015.

Office Action in Japanese Patent Application No. 2014-112741, dated Jan. 26, 2016.

Chinese Office Action dated Jun. 23, 2016, in Chinese Patent Application No. 201510289884.1.

*Primary Examiner* — Erica Lin

(74) *Attorney, Agent, or Firm* — Fitzpatrick, Cella, Harper & Scinto

(57) ABSTRACT

A liquid ejection head with high environmental reliability which suppresses a crack of a Si substrate and peeling-off of an ejection port forming member by relaxing a residual stress in a printing element substrate and a manufacturing method of a liquid ejection head are provided. For that purpose, after the printing element substrate is bonded and fixed to a support member, the support member is screwed and fixed through an elastic member.

2 Claims, 13 Drawing Sheets

(56) References Cited

FOREIGN PATENT DOCUMENTS

| | | | |
|---|---|---|---|
| JP | 2004-330774 | A | 11/2004 |
| JP | 2005-161761 | A | 6/2005 |
| JP | 2007-030379 | A | 2/2007 |
| JP | 2007-076226 | A | 3/2007 |
| JP | 2007-105926 | A | 4/2007 |
| JP | 2009-107299 | A | 5/2009 |
| JP | 2010-000662 | A | 1/2010 |
| JP | 2012-187805 | A | 10/2012 |
| JP | 2014-004692 | A | 1/2014 |

* cited by examiner

LIQUID EJECTION HEAD AND MANUFACTURING METHOD OF LIQUID EJECTION HEAD

BACKGROUND OF THE INVENTION

1. Field of the Invention

The present invention relates to a liquid ejection head mounted on a liquid ejecting device performing a print operation by ejecting a printing liquid such as ink and a manufacturing method of a liquid ejection head.

2. Description of the Related Art

Japanese Patent Laid-Open No. 2002-19146 discloses a liquid ejection head in which a joint seal member is sandwiched between a channel unit formed with a liquid supply path and a support member supporting a printing element substrate and they are press-contacted with each other by a screw to be joined so that the liquid may not leak. The printing element substrate is formed of a silicon (Si) wafer, and a material of the support member uses alumina, e.g., having a linear expansion coefficient equal to that of the printing element substrate.

By making the linear expansion coefficients of the printing element substrate and the support member equal, a stress applied on an adhesive interface between the printing element substrate and the support member caused by a temperature change can be relaxed, and a concern that the printing element substrate is peeled off the support member can be suppressed. Moreover, by sandwiching an elastic member between the channel unit for supplying the liquid to the support member and the support member and screwing and fixing them, ink leak between the channel unit and the support member is prevented, while a manufacturing process is facilitated, and a cost for manufacture is reduced.

However, ink such as ink improved for business which has overcome weak points of the ink having been used in the past such as water resistance or marker resistance has been developed in recent years. With that trend, viscosity of the ink has become high. In order to eject high-viscous ink, it is usually necessary to warm the ink so as to lower the viscosity, but with the support member using alumina, the warmed ink easily cools, and it has been difficult to make the temperature of the ink highly stable before ejection in advance. That is, with the conventional liquid ejection head using alumina for the support member, ink that can be selected is limited. Thus, by changing the material of the support member from alumina which has been used conventionally to a resin, improvement of heat-retaining performance of the printing element substrate can be considered.

Moreover, the printing element substrate of the liquid ejection head has an ejection port forming member for forming an ejection port and a liquid channel for leading a liquid to the ejection port on the substrate on which the printing element is disposed. The ejection port forming member uses an epoxy material as its main material, and it is formed by being patterned on the substrate. In a patterning process, the epoxy material is cured by high-temperature cure. Since the epoxy material with the linear expansion coefficient of approximately 50 ppm/° C. is cured on the Si substrate with the linear expansion coefficient of approximately 7 ppm/° C. at a high temperature, the stress in a direction in which the epoxy material is contracted remains on the Si substrate at a normal temperature after curing.

In a case where the Si substrate with the stress remaining is mounted on the support member formed of a resin, there is a concern as follows. That is, due to a synergic effect of the residual stress of the Si substrate and expansion and contraction of each of the Si substrate and the support member caused by a temperature change in use of the liquid ejection head based on a difference in the linear expansion coefficient between them, the Si substrate might be cracked or the ejection port forming member might be peeled off the Si substrate. Particularly, since the printing element substrate becomes elongated or narrowed in high density, a concern over the crack of the Si substrate or peeling-off of the ejection port forming member grows.

SUMMARY OF THE INVENTION

Thus, the present invention provides, in a liquid ejection head having a printing element substrate in which an ejection port forming member is formed on a Si substrate, a liquid ejection head which suppresses a crack of the Si substrate and peeling-off of the ejection port forming member and has high environmental reliability and a manufacturing method of a liquid ejection head.

Thus, the liquid ejection head of the present invention is a liquid ejection head, including: a printing element unit including a printing element substrate having an ejection port forming member configured to form an ejection port capable of ejecting a liquid and a substrate supporting the ejection port forming member, and a plate-shaped support member configured to support the printing element substrate and having a supply port capable of supplying the liquid to the printing element substrate; and a channel unit in which a channel for leading the liquid to the supply port of the support member is formed, wherein the support member is formed of a resin and includes a pressing unit configured to press so that a center part on a surface opposite to a surface on which the printing element substrate of the printing element unit is mounted becomes convex.

According to the present invention, a liquid ejection head which suppresses a crack of the Si substrate and peeling-off of the ejection port forming member and has high environmental reliability can be realized.

Further features of the present invention will become apparent from the following description of exemplary embodiments (with reference to the attached drawings).

DESCRIPTION OF THE EMBODIMENTS

First Embodiment

A first embodiment of the present invention will be described below by referring to the attached drawings.

Figure 1:
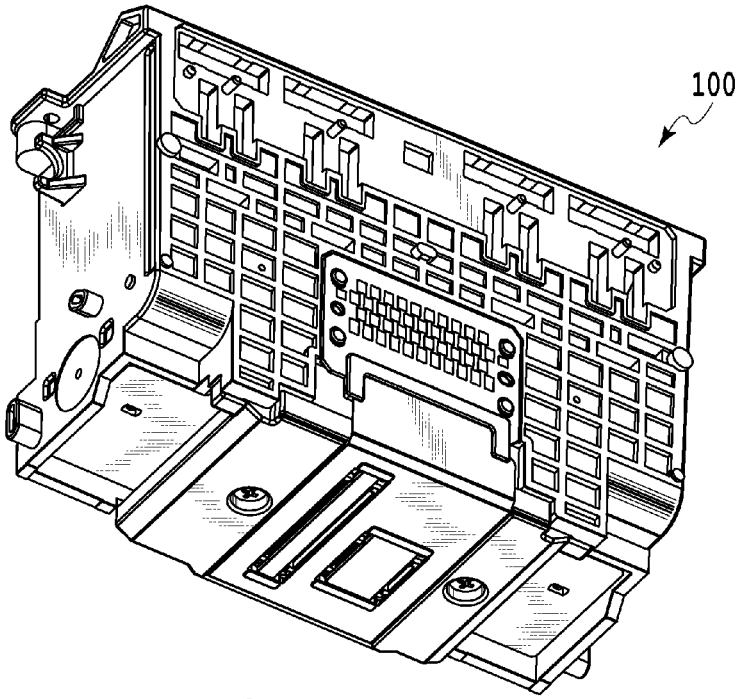
FIG. 1 is a schematic diagram illustrating a liquid ejection head of a first embodiment.
Figure 2:
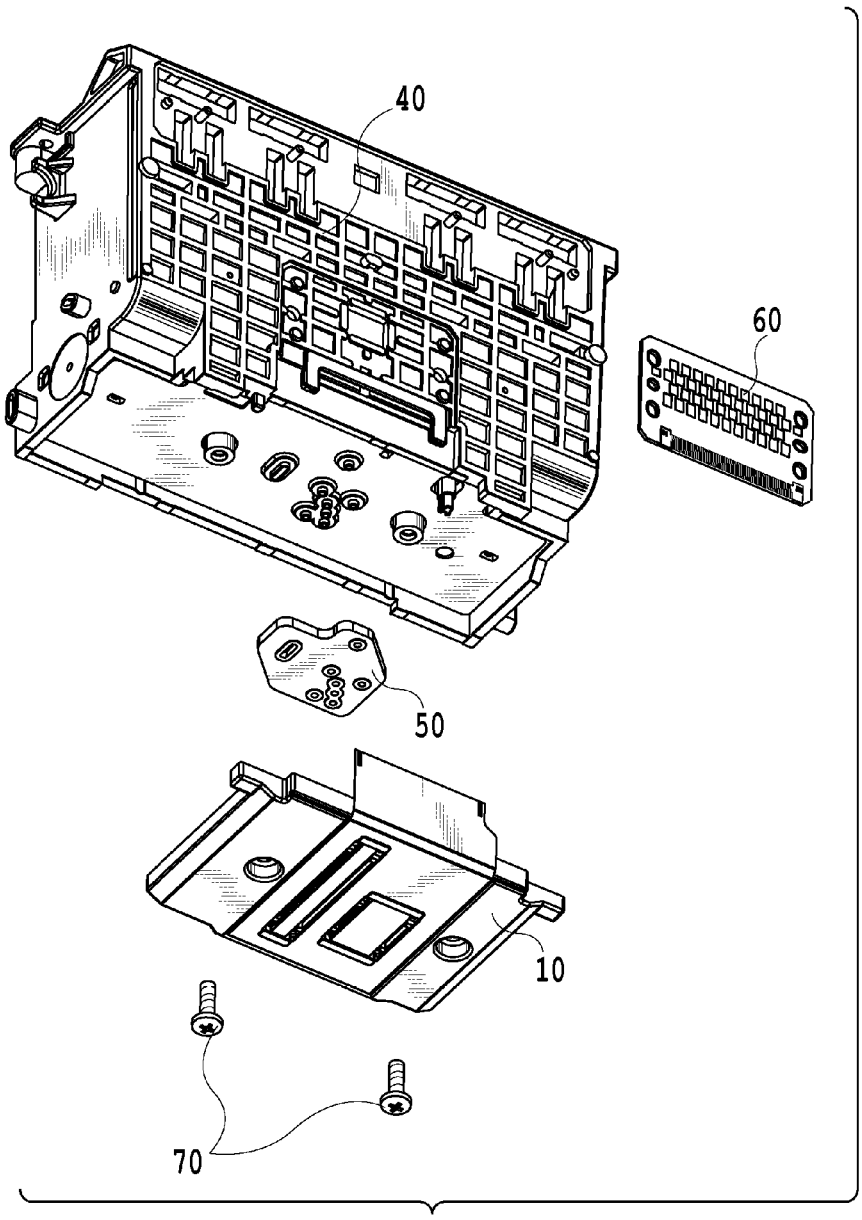
FIG. 2 is an exploded view of the liquid ejection head.
Figure 3:
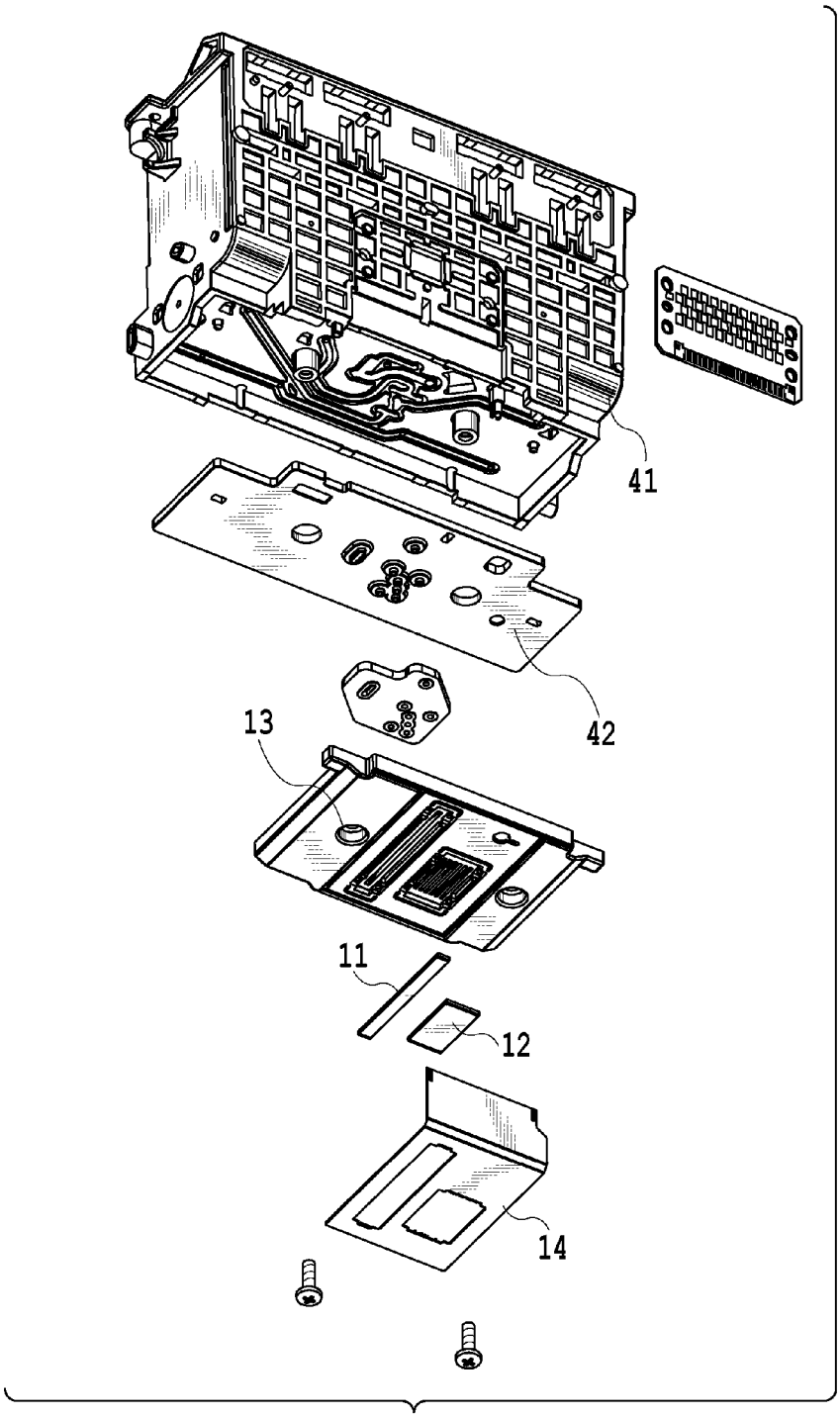
FIG. 3 is an exploded view of the liquid ejection head.

FIG. 1 is a schematic diagram illustrating a liquid ejection head of the first embodiment, and FIGS. 2 and 3 are exploded views of the liquid ejection head. A liquid ejection head 100 has a printing element unit 10, a channel unit 40, an elastic member 50, an electric substrate 60, and a screw 70. The printing element unit 10 has printing element substrates 11 and 12, a plate-shaped support member (first support member) 13, and an electric wiring substrate 14, and the channel unit 40 (second support member) has a housing 41 and a channel plate 42.

The channel unit 40 has the channel plate 42 bonded and fixed to the housing 41 by ultrasonic welding so as to form a liquid supply path for leading a liquid from an ink tank (not shown) for storage to a liquid inlet. The housing 41 and the channel plate 42 are formed of a resin such as a modified polyphenylene ether resin in view of workability of ultrasonic welding. In a case where component strength is needed, a glass filler may be contained as necessary.

Figure 4A:
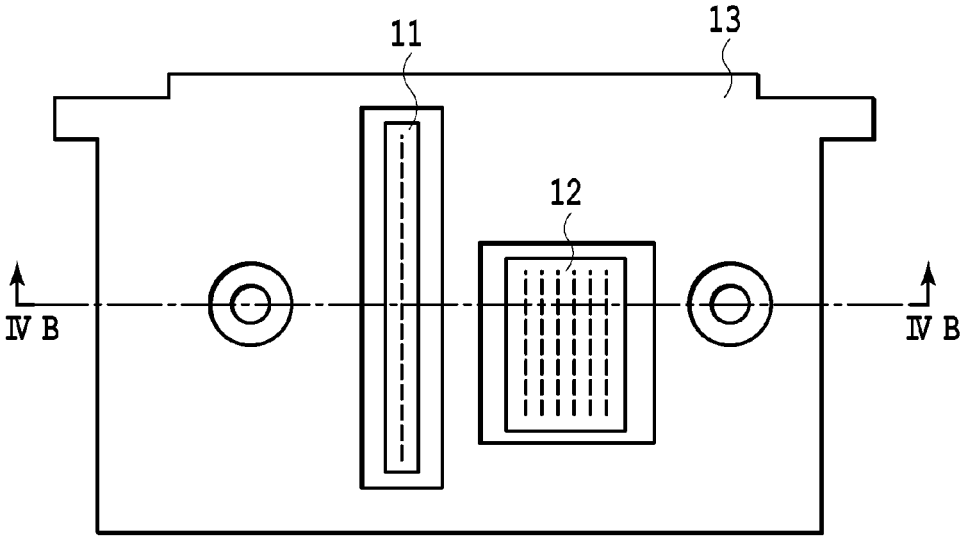
FIG. 4A is a view for explaining a printing element unit.
Figure 4B:
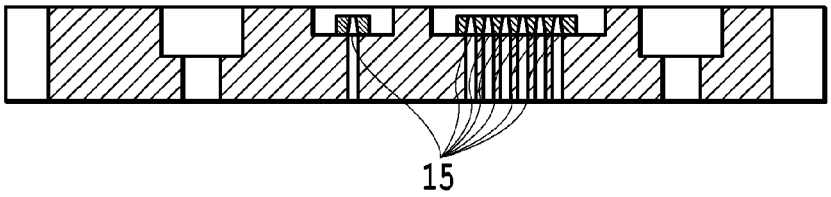
FIG. 4B is a view for explaining a printing element unit.

FIGS. 4A and 4B are views for explaining the printing element unit 10 of the first embodiment, in which FIG. 4A is a front view and FIG. 4B is a sectional view. The printing element substrates 11 and 12 are provided with a plurality of ejection ports capable of ejecting a liquid, and the printing element substrate 11 for BK (black) ink has one through hole 15 and the printing element substrate 12 for CL (color) ink has six through holes 15. The printing element substrate 11 for BK ink has an ejection port array elongated to 1.1 inches in order to improve a printing speed. Moreover, regarding both the printing element substrate 11 for BK ink and the printing element substrate 12 for CL ink, their densities are increased and widths are made narrower for more inexpensive manufacture. Specifically, a width of the printing element substrate 11 for BK ink is approximately 2 mm and a width of the element substrate 12 for CL ink is approximately 8 mm. The printing element substrates 11 and 12 are bonded and fixed to the support member 13. The support member 13 is formed of a resin such as modified polyphenylene ether resin.

The support member 13 may contain a glass filler as necessary in view of planarity and thermal expansion coefficient. As an adhesive material used for bonding between the printing element substrates 11 and 12 and the support member 13, a thermosetting epoxy resin is used, and its thickness is controlled to approximately 0.01 to 0.2 mm so that variation in planarity of the support member 13 may be absorbed.

Figure 5:
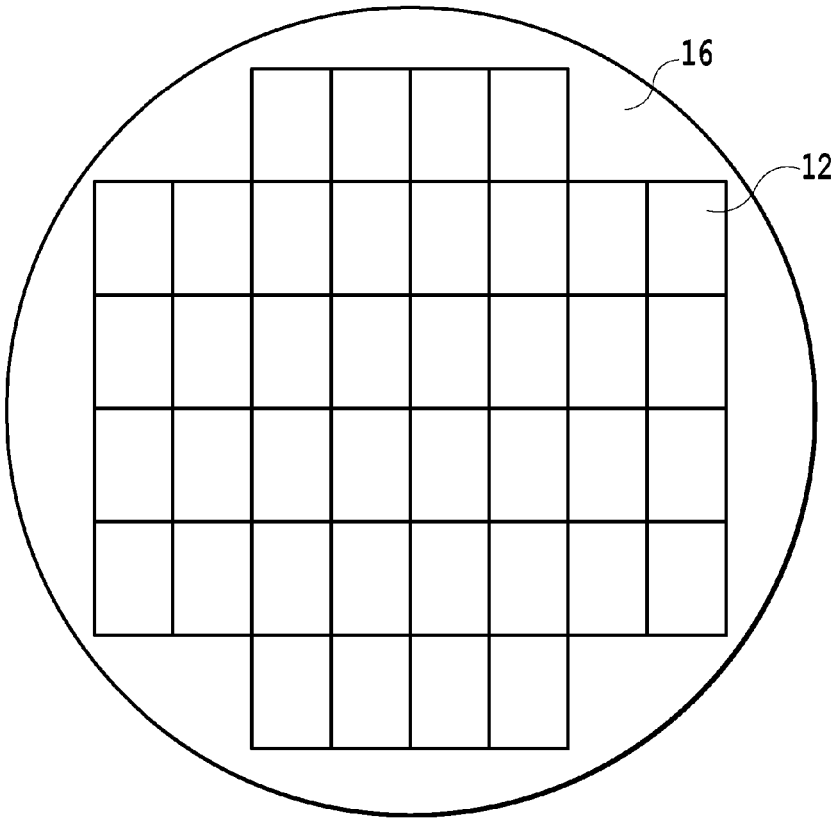
FIG. 5 is a view for explaining a printing element substrate of the first embodiment.
Figure 6A:
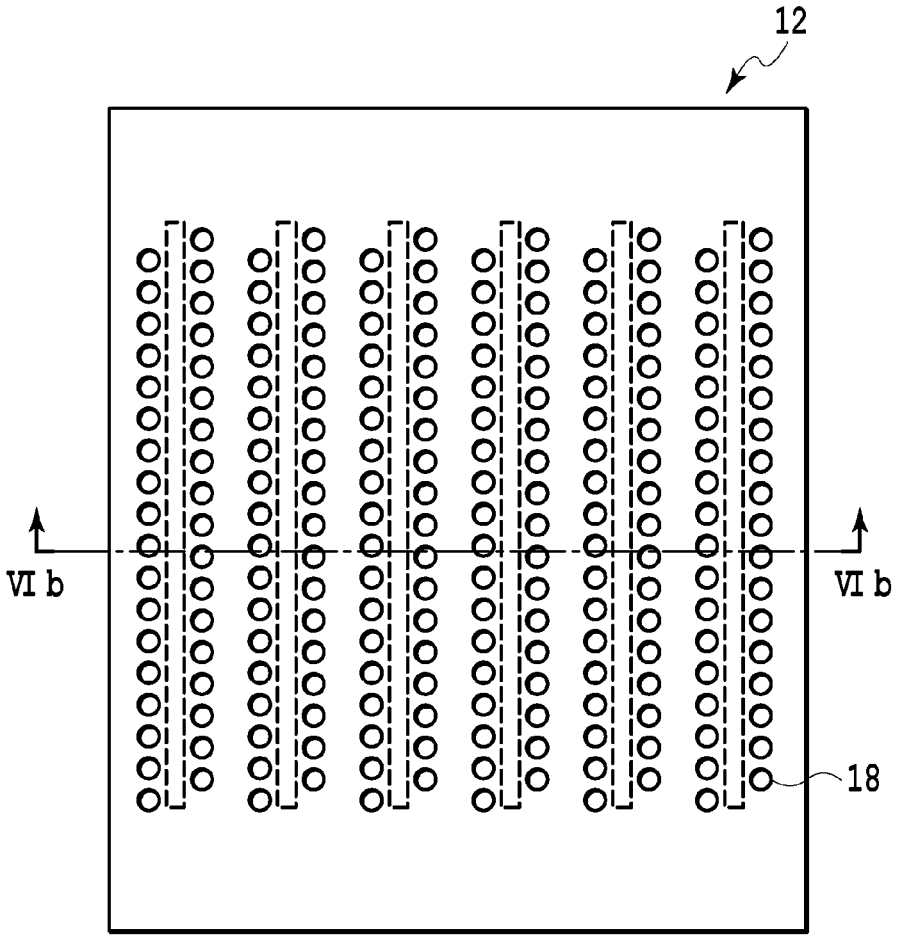
FIG. 6A is a view for explaining a printing element substrate of the first embodiment.
Figure 6B:
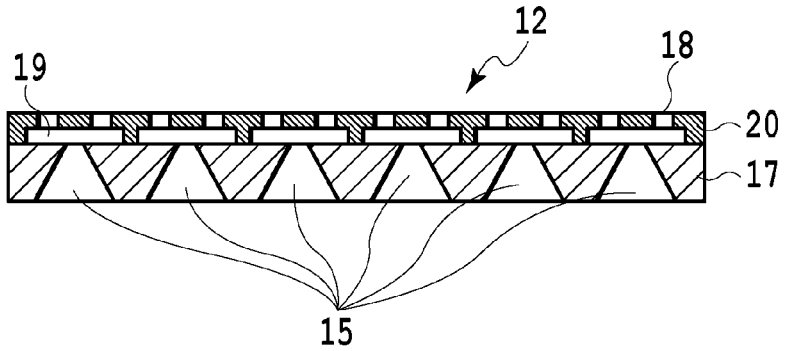
FIG. 6B is a view for explaining a printing element substrate of the first embodiment.

FIGS. 5, 6A and 6B are views for explaining the printing element substrate 12 of the first embodiment. The printing element substrate 12 is manufactured in plural by the wafer 16 at a time. On a Si substrate 17 in which an energy generating element (not shown) for generating an energy to be applied to a liquid is formed with a semiconductor process, an ejection port forming member 20 forming an ejection port 18 and a liquid channel 19 is formed by patterning. The through hole 15 for supplying the liquid is formed by an etching process. The ejection port forming member 20 uses an epoxy material. On the Si substrate having a linear expansion coefficient of approximately 7 ppm/° C., an epoxy material having a linear expansion coefficient of approximately 50 ppm/° C. is cured by high-temperature cure and thus, the stress in a direction in which the epoxy material contracts remains on the printing element substrate 12 at a normal temperature after curing.

Figure 7A:
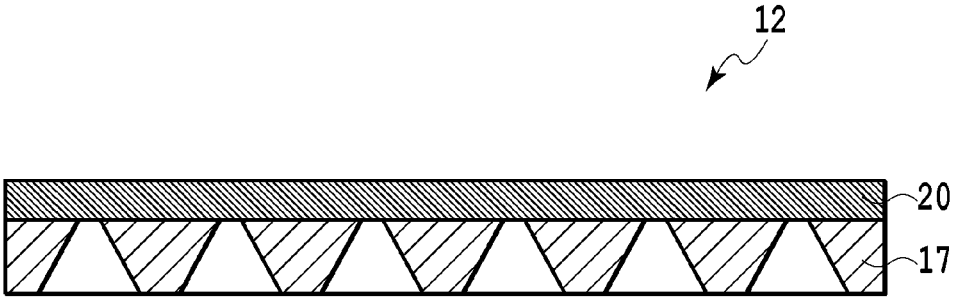
FIG. 7A is a view for explaining a state of a residual stress of the printing element substrate.
Figure 7B:
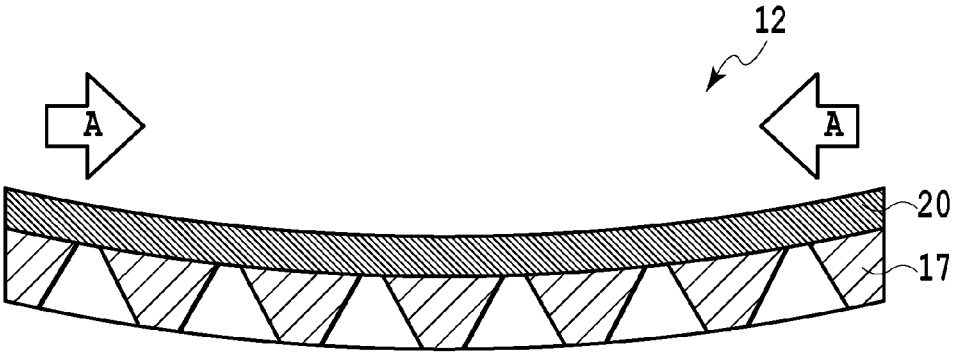
FIG. 7B is a view for explaining a state of a residual stress of the printing element substrate.

FIGS. 7A and 7B are views for explaining a state of the residual stress of the printing element substrate 12 of the first embodiment. FIG. 7A illustrates the printing element substrate 12 not influenced by the residual stress, while FIG. 7B illustrates the printing element substrate 12 influenced by the residual stress. Since the stress in a direction of an arrow A which is the direction in which the ejection port forming member 20 contracts remains, a force such that the center part is dented by the residual stress is applied to the printing element substrate 12.

Figure 8:
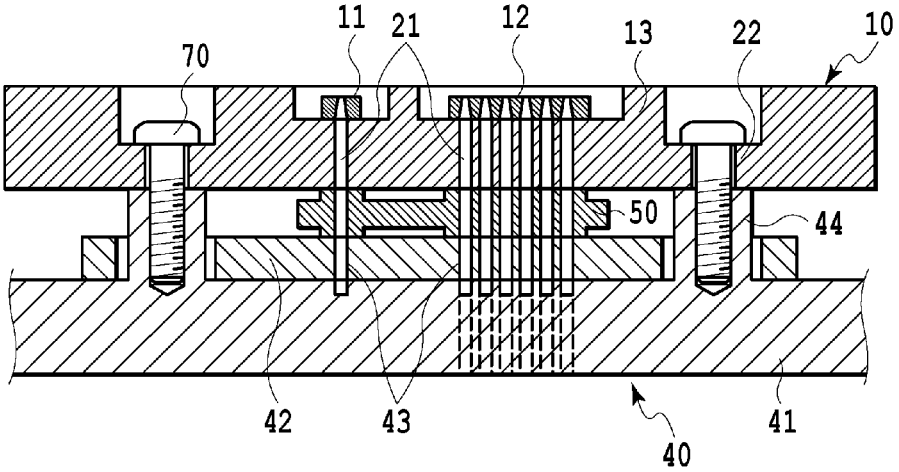
FIG. 8 is a sectional view for explaining the liquid ejection head of the first embodiment.

FIG. 8 is a sectional view for explaining the liquid ejection head 100 of the first embodiment. On the support member 13, a liquid supply port 21 capable of supplying the liquid to the printing element substrates 11 and 12 is provided, while on the channel plate 42, a liquid inlet 43 is provided. In the support member 13, a hole 22 for screwing is provided on both ends thereof, and a screwing port 44 is provided on the housing 41 on which the channel plate 42 is mounted. The liquid supply port 21 of the support member 13 and the liquid inlet 43 of the channel plate 42 are arranged at opposing positions, and the elastic member 50 has a through hole at a position corresponding to opening positions of both. The printing element unit 10 and the channel unit 40 are joined by a screw by sandwiching the elastic member 50. As a result, the liquid inlet 43 and the liquid supply port 21 are made to communicate with each other through the through hole of the elastic member 50.

Figure 9:
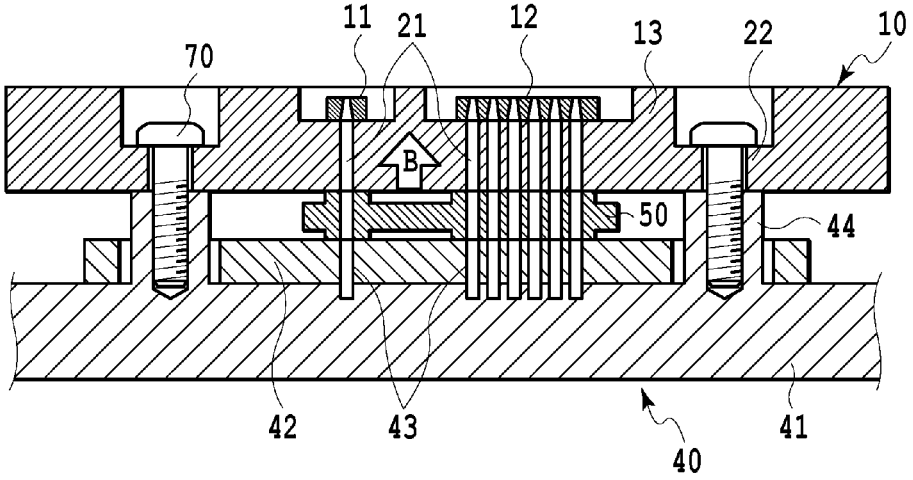
FIG. 9 is a view for explaining the liquid ejection head of the first embodiment.

FIG. 9 is a view for explaining the liquid ejection head 100 of the first embodiment. Since the support member 13 is formed of a resin material, by screwing and fixing it by sandwiching the elastic member 50, a surface opposite to the surface to which the printing element substrates 11 and 12 of the support member 13 are bonded is pressed by the elastic member 50. By means of this pressing force by the elastic member 50, a stress in a direction of an arrow B is applied to the support member 13, and a force such that the center part becomes convex is applied to the support member 13. This stress influences the printing element substrates 11 and 12 bonded and fixed to the support member 13, and the force is also applied to the printing element substrates 11 and 12 such that the center part becomes convex. As a result, the residual stress of the printing element substrates 11 and 12 is relaxed.

As described above, after the printing element substrates 11 and 12 are bonded and fixed to the support member 13, the support member 13 is screwed and fixed through the elastic member 50 so that the residual stress of the printing element substrates 11 and 12 can be relaxed.

As a result, at a temperature change or humidity change, a crack of the Si substrate or peeling-off of the ejection port forming member which might be caused by the residual stress of the printing element substrate can be suppressed, and the liquid ejection head with high environmental reliability and the manufacturing method of the liquid ejection head can be realized.

Moreover, in this embodiment, since the residual stress remaining on the printing element substrate increases due to elongation and narrowing of the width of the printing element substrate, the effect of suppressing the crack of the Si substrate or the peeling-off of the ejection port forming member by relaxation of the residual stress is large.

In this embodiment, the screw is used for fixing the support member 13, but this is not limiting. That is, anything can be used as long as it is capable of fixation by pressing with the elastic member so that the center part of the support member 13 becomes convex, and fixation may be performed by a retaining ring or an E-ring and a pin, for example.

Moreover, in this embodiment, the configuration in which the support member 13 is pressed by sandwiching the elastic member 50 between the support member 13 and the channel unit 40 and fixing it with the screw is described, but this is not limiting. That is, any configuration can be used as long as it is capable of pressing so that the center part of the support member 13 becomes convex in a case where it is fixed, and the channel unit 40 and the elastic member may be integrally configured, for example.

Second Embodiment

A second embodiment of the present invention will be described below by referring to the attached drawings. Since the basic configuration of this embodiment is similar to that of the first embodiment, only a characteristic configuration will be described below.

Figure 10:
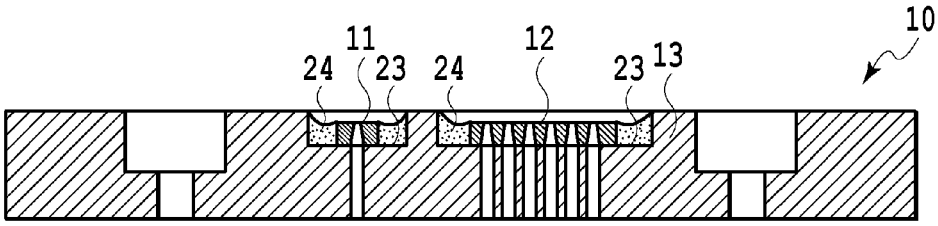
FIG. 10 is a view for explaining a printing element unit of a second embodiment.

FIG. 10 is a view for explaining a printing element unit of the second embodiment. Since the configurations other than the printing element unit are the same as those of the liquid ejection head of the first embodiment, explanation will be omitted. In the support member 13, a concave portion 23 for accommodating the printing element substrates 11 and 12 in the thickness direction of the support member 13 is provided. Outer peripheries (or at least a part thereof) of the printing element substrates 11 and 12 bonded and fixed to the concave portion 23 of the support member 13 are sealed by a sealing material 24. Since the support member 13 is formed of a resin, the concave portion 23 can be provided easily. By sealing the outer peripheries of the printing element substrates 11 and 12, the outer peripheries of the printing element substrates 11 and 12 are prevented from being eroded by ink or the like. The sealing material might be swollen in a case where the ink adheres thereto and moisture is absorbed in actual use of the liquid ejection head.

Figure 11:
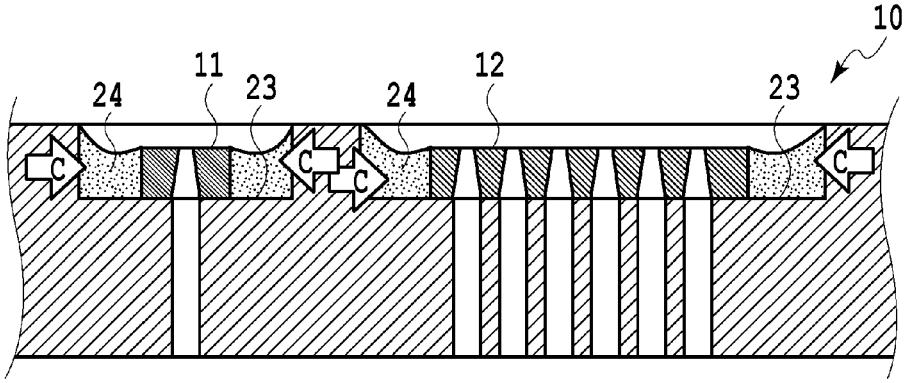
FIG. 11 is a view illustrating the printing element unit of the second embodiment.

FIG. 11 is a view illustrating the printing element unit of the second embodiment. In a case where the sealing material 24 is swollen, as illustrated in FIG. 11, a stress in a direction of an arrow C is applied to the printing element substrates 11 and 12, and the stress in the direction such that the center part is dented is promoted in the printing element substrates 11 and 12. Then, in this embodiment, too, since the support member 13 is formed of a resin material, by sandwiching the elastic member 50 and by screwing and fixing it, a force acts in the support member 13 such that the center part becomes convex by a repulsion force (pressing force) of the elastic member 50. This stress also influences the printing element substrates 11 and 12 bonded and fixed to the support member 13, and the force acts such that the center parts of the printing element substrates 11 and 12 also become convex. As a result, the residual stress remaining on the printing element substrates 11 and 12 is relaxed.

As described above, after the printing element substrates 11 and 12 are bonded and fixed to the support member 13, by screwing and fixing them through the elastic member, the residual stress remaining on the printing element substrates 11 and 12 can be relaxed. As a result, the liquid ejection head with high environmental reliability which can suppress the crack of the Si substrate or the peeling-off of the ejection port forming member which might be caused by the residual stress of the printing element substrate at a temperature change or humidity change and the manufacturing method of the liquid ejection head can be provided.

Moreover, the residual stress remaining on the printing element substrate increases due to elongation and narrowing of the width of the printing element substrate, but the crack of the Si substrate or the peeling-off of the ejection port forming member can be suppressed by relaxation of the residual stress by screwing and fixation.

Moreover, regarding the stress by swelling of the sealing material caused by provision of the sealing material in the periphery of the printing element substrate, too, the crack of the Si substrate or the peeling-off of the ejection port forming member can be suppressed by relaxation of the residual stress by screwing and fixation.

Other Embodiments

Figure 12:
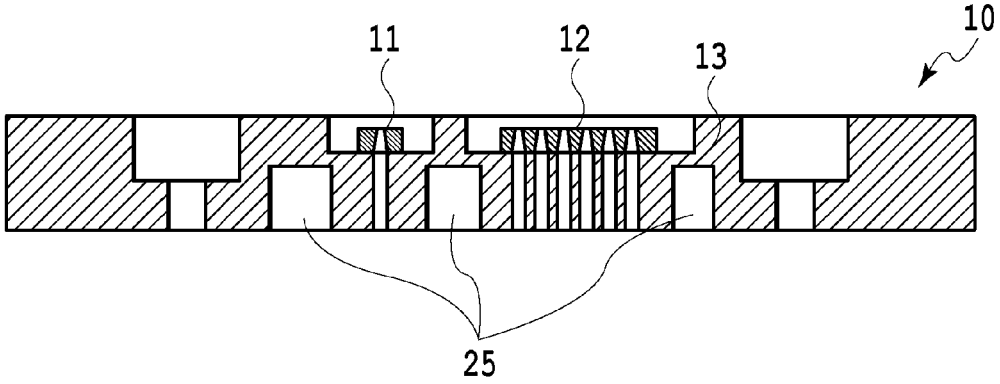
FIG. 12 is a view for explaining a printing element unit of another embodiment.

FIG. 12 is a view for explaining a printing element unit of another embodiment. Since the configurations of other than the printing element unit are similar to those of the liquid ejection head of the first embodiment, explanation will be omitted.

A concave portion is formed on a back surface side of a side on which the printing element substrates 11 and 12 of the support member 13 are formed, whereby a thin portion 25 where a thickness of the support member 13 is small is formed. By providing the thin portion 25 on the support member 13 and screwing and fixing it, the stress applied to the support member 13 is changed. As a result, the stress applied to the printing element substrates 11 and 12 is changed, and the residual stress can be relaxed. In a case where the thickness of the thin portion 25 is small, deformation of the thin part becomes larger, and the stress applied to the printing element substrates tends to become small. As illustrated in FIG. 12, the thickness of the thin portion 25 of the support member 13 is smaller than a thickness of a portion on which the printing element substrates 11 and 12 are disposed. By providing the thin portion 25 between the screwing portion and the printing element substrates as above, the center part of the support member 13 can be deformed easily to be convex at fixation by screwing and thus, the residual stress remaining on the printing element substrates 11 and 12 is relaxed, which is preferable.

Since the support member 13 is formed of a resin, the thin portion 25 can be easily provided in molding of the support member. Depending on the lengths, widths and the numbers of through holes of the printing element substrates 11 and 12, the shape of the thin portion can be changed so as to handle them. In this embodiment, the thin portion 25 is provided by providing a counterbore from the back surface of the support member 13, but the thin portion may be provided by providing a counterbore from the front surface of the support member 13.

Figure 13:
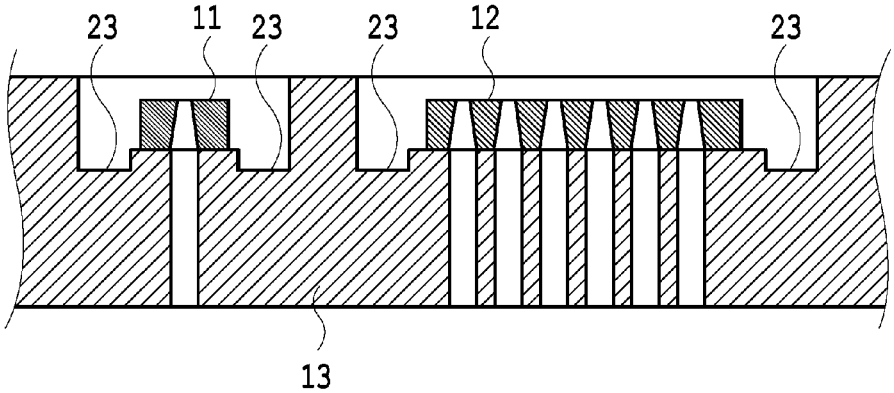
FIG. 13 is a view for explaining a printing element unit of another embodiment.

FIG. 13 is a view for explaining a printing element unit of another embodiment. Since the configurations of other than the printing element unit are similar to those of the liquid ejection head of the first embodiment, explanation will be omitted. The concave portion 23 of the support member 13 is provided deeper than a surface on which the printing element substrates 11 and 12 are bonded and fixed. By making the concave portion deeper than the surface on which the printing element substrates are bonded and fixed, even in the case where the sealing material is provided in the periphery of the printing element substrates 11 and 12, an intrusion amount of the sealing material into the concave portion 23 can be managed, and an influence by swelling of the sealing material can be controlled.

Depending on the lengths, widths and the numbers of through holes of the printing element substrates 11 and 12, the shape of the concave portion can be changed so as to handle them. In this embodiment, they are handled by the shape in the depth direction, but handling can be made as necessary also in the shape in a planar direction.

In this embodiment, too, since the support member 13 is formed of a resin material, by screwing and fixing it by sandwiching the elastic member 50, the support member 13 is deformed so that the center part becomes convex by the repulsion force of the elastic member 50. This stress also influences the printing element substrates 11 and 12 bonded and fixed to the support member 13, and the printing element substrates 11 and 12 are also deformed so that the center parts become convex. As a result, the residual stress remaining on the printing element substrates 11 and 12 is relaxed.

As described above, after the printing element substrates 11 and 12 are bonded and fixed to the support member 13, by screwing and fixing them through the elastic member, the residual stress remaining on the printing element substrates 11 and 12 can be relaxed.

As a result, the liquid ejection head with high environmental reliability which can suppress the crack of the Si substrate or the peeling-off of the ejection port forming member which might be caused by the residual stress of the printing element substrate at a temperature change or humidity change and the manufacturing method of the liquid ejection head can be provided.

Moreover, the residual stress remaining on the printing element substrate increases due to elongation and narrowing of the width of the printing element substrate, but the crack of the Si substrate or the peeling-off of the ejection port forming member can be suppressed by relaxation of the residual stress by screwing and fixation.

Moreover, by changing the shapes of the thin portion of the support member or the concave portion, handling is made possible in accordance with the width of the printing element substrate, the number of through holes and the like, and the crack of the Si substrate or the peeling-off of the ejection port forming member can be suppressed by relaxation of the residual stress by screwing and fixation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112741, filed May 30, 2014, which is hereby incorporated by reference herein in its entirety.

What is claimed is:

1. A liquid ejection head, comprising:

a printing element substrate including an ejection port ejecting a liquid;

a plate-shaped first support member formed of a resin, configured to support the printing element substrate and including a supply port for supplying the liquid to the printing element substrate;

a second support member configured to support the first support member and formed with a channel for supplying the liquid to the first support member; and a first screw and a second screw for joining the first support member and the second support member, the first screw being provided at one side of the printing element substrate, and the second screw being provided at the other side of the printing element substrate, wherein the first support member includes a thin portion having a thickness smaller than a thickness of a portion of the first support members where the printing element substrate is disposed, the thin portion being provided between a portion of the first support member where one of the first screw and the second screw is disposed and the portion where the printing element substrate is disposed, and wherein the first support member is deformed so that a portion between the second screw and the first screw becomes convex toward a side at which the printing element substrate is provided.

2. The liquid ejection head according to claim 1, wherein an elastic member is disposed between the first support member and the second support member.

* * * * *